United States Patent [19]

Garlick

[11] 4,170,816

[45] Oct. 16, 1979

[54] CATHODE STARTING SHEET ASSEMBLY MACHINES

[76] Inventor: Thomas W. Garlick, 1 Sicilian House, Sicilian Ave., London, England, WCIA 2QD

[21] Appl. No.: 870,648

[22] Filed: Jan. 19, 1978

[30] Foreign Application Priority Data

Jan. 20, 1977 [GB] United Kingdom ..... 2337/77

[51] Int. Cl.[2] ..... C25D 17/00; B21J 15/00; B23P 11/00

[52] U.S. Cl. ..... 29/432.1; 29/243.53; 29/33 J; 29/761; 29/513; 29/563

[58] Field of Search ..... 29/243.5, 243.53, 38 A, 29/423, 430, 432, 432.1, 432.2, 513, 563, 564, 623.1, 746, 761, 785, 792, 798, 743, 33 J, 33 R, 38 C, 35.5; 204/198, 199; 271/8 A; 227/105

[56] References Cited

U.S. PATENT DOCUMENTS

| | | | |
|---|---|---|---|
| 3,199,170 | 8/1965 | Johansson | 29/33 R |
| 3,343,244 | 9/1967 | Baublys et al. | 29/33 J |
| 3,410,387 | 11/1968 | Wennberg et al. | 198/817 |
| 3,711,923 | 1/1973 | Kasper | 29/430 |
| 3,848,326 | 11/1974 | Lehtovaara | 29/761 |
| 3,927,454 | 12/1975 | Kobayashi et al. | 29/743 |
| 3,982,321 | 9/1976 | Kasper | 204/198 |
| 4,003,805 | 1/1977 | Schaer et al. | 204/199 |
| 4,077,106 | 3/1978 | Lichtenstein | 29/785 |

*Primary Examiner*—Milton S. Mehr
*Attorney, Agent, or Firm*—Oblon, Fisher, Spivak, McClelland & Maier

[57] ABSTRACT

The invention relates to securing hanging-loops to cathode starting sheets and an assembly machine is disclosed which comprises a turntable having five circumferentially spaced, flat, tables the surface of each of which is substantially vertical, indexing means for indexing the turntable about the vertical axis through a sheet loading station, a loop strip loading station, a loop-rivetting station and an assembled-sheet-removal station, a sheet loading mechanism at the loading station, a loop strip loading mechanism the loop-strip loading station, a loop strip bending mechanism and a loop-rivetting mechanism at the loop-rivetting station, and a finished-sheet-removal mechanism at the assembled-sheet-removal station.

16 Claims, 4 Drawing Figures

CATHODE STARTING SHEET ASSEMBLY MACHINES

BACKGROUND OF THE INVENTION

This invention relates to cathode starting sheet assembly machines. The term starting sheet is applied to the relatively thin sheet which initially comprises the cathode in copper, nickel and other refining. The sheets are made of pure copper or nickel 8 typically are about 1,000×1,000×8mm thick and are required in large numbers for both electro-winning and electro-refining plants. With typical cathode weights of 140–160 kgs (as in refining/electro-winning plants) some 1,200–2,800 sheets are required per day for a cathode production of 50,000 tons per year. The starting sheets in copper refining are suspended in the tanks by horizontal bars which pass through one or more inverted U-shaped loops, the lower ends of the limbs of the loops being rivetted to the upper edge of the starting sheet. In the case of nickel sheets the loops are spot welded rather than rivetted. It is a well known fact that the sheet is susceptible to distortion during handling. Unless it is flat and hanging vertically when placed in the electrolitic cell the efficiency of the process is seriously reduced. A considerable proportion of the labour employed in the tankhouse is involved in the stripping and assembly of the starting sheets. If their quality is poor and particularly if they are bent or warp in service, and do not hang vertically, the current efficiency and cathode output of the tankhouse can be seriously diminished.

In the earliest refineries of any size the loops were attached to the sheets by means of conventional mechanical presses fitted with special tools. Two men were required at each machine and they passed the assembled sheets onto other men who pounded the sheet flat, pushed the suspension bar through the loops and manually placed the assembled sheet in a storage bolster. Generally when flattening the sheets the men beat in them a shallow diagonal cross which tends to stiffen the sheet. Because the quality of the sheets was often poor it was usual in those days to remove each two day old cathode from the cells for a short while in order to beat it flat again on an inclined stand which was mobile and used on the top of the cell. This operation was called "wet flapping".

In the late 1960's because of increasing labour costs and the difficulty in some countries of obtaining labour at all willing to perform the above mentioned type of work, new methods of preparing the sheets were developed. The most successful was an automatic sheet assembly machine developed at Boliden, Sweden, in 1960 which was later marketed by C. J. Wennberg A.B. This progressive automation is described in the transactions of the metallurgical Society of A.I.M.E. Volume 236 pages 1570–1573, published November 1966. This described an automated system installed in a new tankhouse at the copper refinery at Boliden, Sweden. In that process flattened sheets are fed horizontally along a processing path and the loops and bars are connected to the sheets whilst they are in their horizontal position, whereafter the sheets are turned through 90° whilst still in their horizontal plane, and then turned vertically and placed on a storage conveyor. A machine of this type is also shown in British Specification No. 957,962 and its corresponding U.S. Pat. No. 3,199,170.

Another British Specification No. 115,713 in the name of Wennberg also shows a similar apparatus wherein the starting sheets are again turned from a horizontal position to a vertical position. During such turning there is a danger of distortion of the sheet unless it is fully supported throughout the transfer period.

Besides the machines referred to above, others having a roughly similar capacity and degree of automation are known to those engaged in the art but in all of them the sheet is moved, rivetted and assembled in a substantially horizontal position until it is finally transferred to a vertical position on the storage or spacing conveyor or rack. This is true even of the very latest models of the aforementioned machines.

As has been mentioned, the processes and apparatus which have been referred to in these prior documents are in general automatic processes which have led to the minimisation of the amount of labour involved and whilst this objective is a very desirable one, particularly where labour costs are high, it does involve the design of relatively complicated machinery which can for example for a complete starting sheet assembly machine of high capacity (say 600 sheets per hour) cost in the order of £ 300,000, ($600,000).

Apart from the high cost involved, a common weakness of high automation is that the slightest breakdown in one of the many parts of the machine causes the whole of the machine to have to be stopped until the fault is rectified. During all this time the three of four operators or supervisors attending the machine are idle and its entire output is lost. These machines also occupy considerable floor space since the sheets are moved through the machine in a horizontal position and only after assembly is completed are they upended to a vertical position for placing on the storage conveyor. As has been mentioned, while being upended the sheet has to be fully supported since otherwise it would be bent or damaged. The stop - go movement of the sheets through the preceding sections of the machine at high speed is also troublesome because, to minimise inertia the conveyor mechanisms are made as light as possible and accurate sheet location and guidance is difficult to maintain. Without exception, all the high automated high speed machines previously referred to, handle the sheets horizontally until placing them on the storage conveyor.

The present invention is of particular application in areas where labour availability is considerable and local labour costs relatively low and the invention starts from the premise that in such circumstances it is better to use say two or more slower and simpler machines which are together capable of the same total output as a fully automatic high speed one. Even though the attendant labour may be increased by one or two the capital cost is considerably less and the reliability greater. The lost labour time and lost sheet production is also reduced since it is unlikely that both machines would be simultaneously out of order. The time and money spent on maintaining the one large high speed fully automated machine in servicable condition is always quite considerable, and likely to be at least equal, if not more, than that of maintaining two machines of the same total capacity, since their slower individual speeds permits the use of simpler constructions and handling mechanisms.

SUMMARY OF THE INVENTION

According to one aspect the invention concerns a cathode starting sheet assembly machine comprising a flat support table arranged to support a starting sheet substantially vertically, and means for shifting the support table successively through a sheet loading station, a loop-securing station and an assembled-sheet-removal station.

According to a specific aspect of the invention a cathode starting sheet assembly machine comprises a vertical axis turntable having at least three circumferentially spaced, flat, tables the surface of each of which is substantially vertical, and indexing means for indexing the turntable about the vertical axis successively through a sheet loading station, a loop-securing station and an assembled-sheet-removal station.

Specifically the cathode starting sheet assembly machine may comprise a vertical axis turntable affording a plurality of circumferentially spaced flat tables the surface of each of which is substantially vertical, indexing means for indexing the turntable about the vertical axis through a sheet loading station, a loop strip loading station, a loop-rivetting station and an assembled-sheet-removal station, a sheet loading mechanism at the loading station, a loop strip loading mechanism at the loop-strip loading station, a loop strip bending mechanism and a loop-rivetting mechanism at the loop-rivetting station, and a finished-sheet-removal mechanism at the assembled-sheet-removal station.

The invention also concerns a method of securing a loop to a cathode starting sheet comprising placing a starting sheet on a support while the support is at a loading station, the support supporting the sheet substantially vertically, shifting the sheet support to a loop securing station, securing a loop to the sheet while it is at the loop securing station, shifting the sheet support to a sheet removal station and removing the sheet and secured loop from the support.

DESCRIPTION OF THE DRAWINGS

The invention may be carried into practice in a number of ways but one specific embodiment will now be described by way of example with reference to the accompanying drawings in which.

DESCRIPTION OF THE PREFERRED EMBODIMENTS

Figure 1:
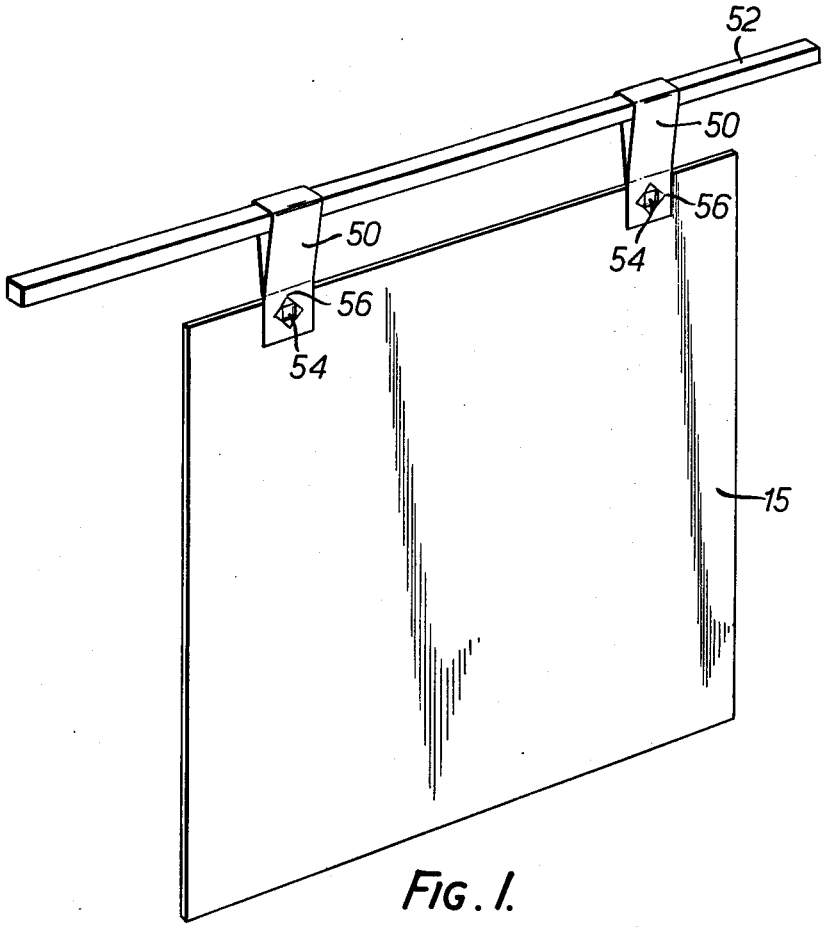
FIG. 1 is a perspective view of a starting sheet supported by a bar by a pair of loops connected to the sheet by apparatus according to the invention.

Referring firstly to FIG. 1, this shows a generally square starting sheet 15 to which a pair of loops 50 have been connected by apparatus according to the invention, a bar 52 extending through the loops 50. Each loop 50 is connected to the sheet 15 by a rivet connection 54 formed by first piercing the lower ends of the loops and the sheet to produce rectangular holes by piercing from the far side to form four triangular broken tongues of material 56. In a manner to be described these tongues are then turned back against the rear face of the loops as shown in FIG. 1. In other words no actual rivets are employed.

Figure 2:
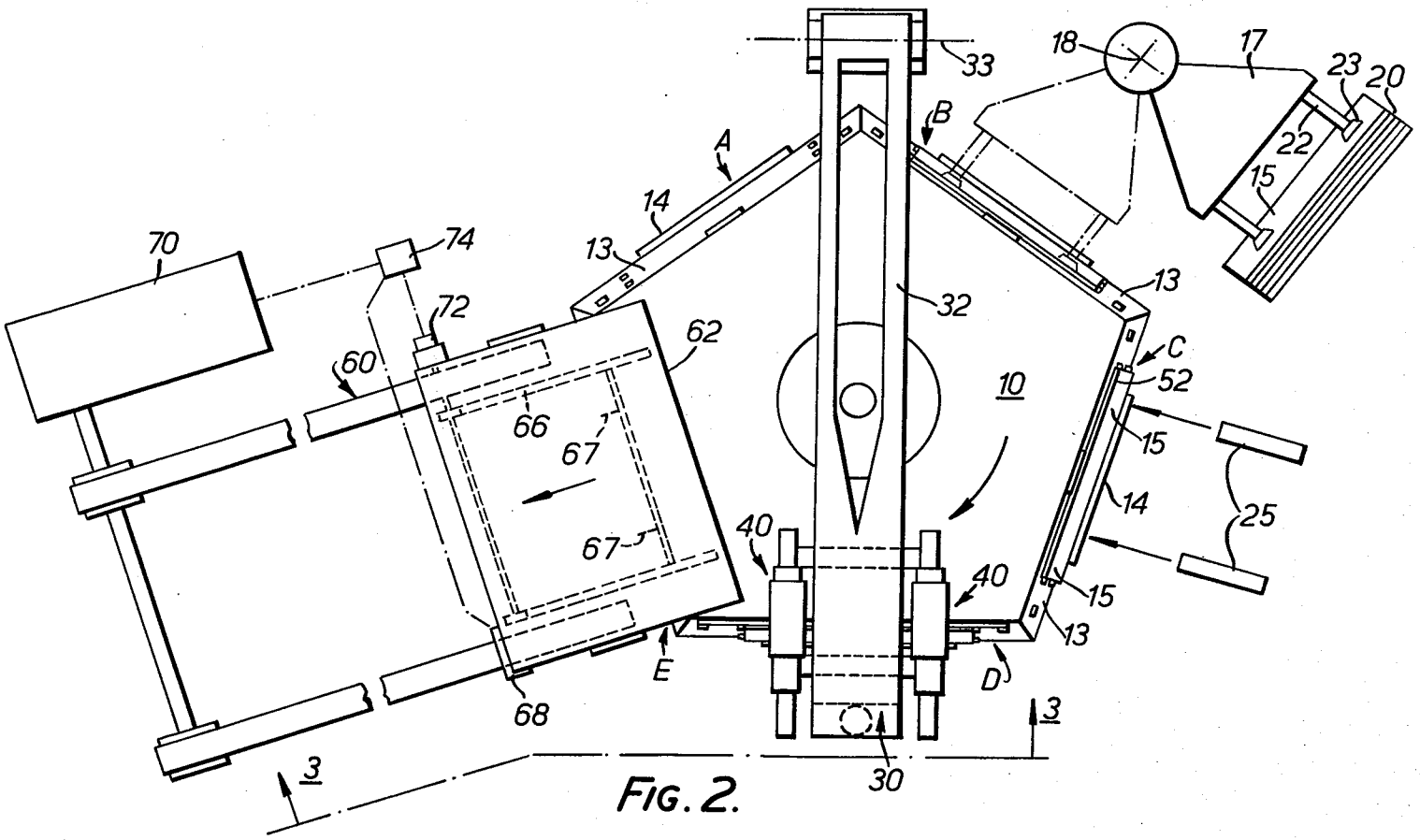
FIG. 2 is a plan view of a starting sheet assembly machine according to the present invention.
Figure 3:
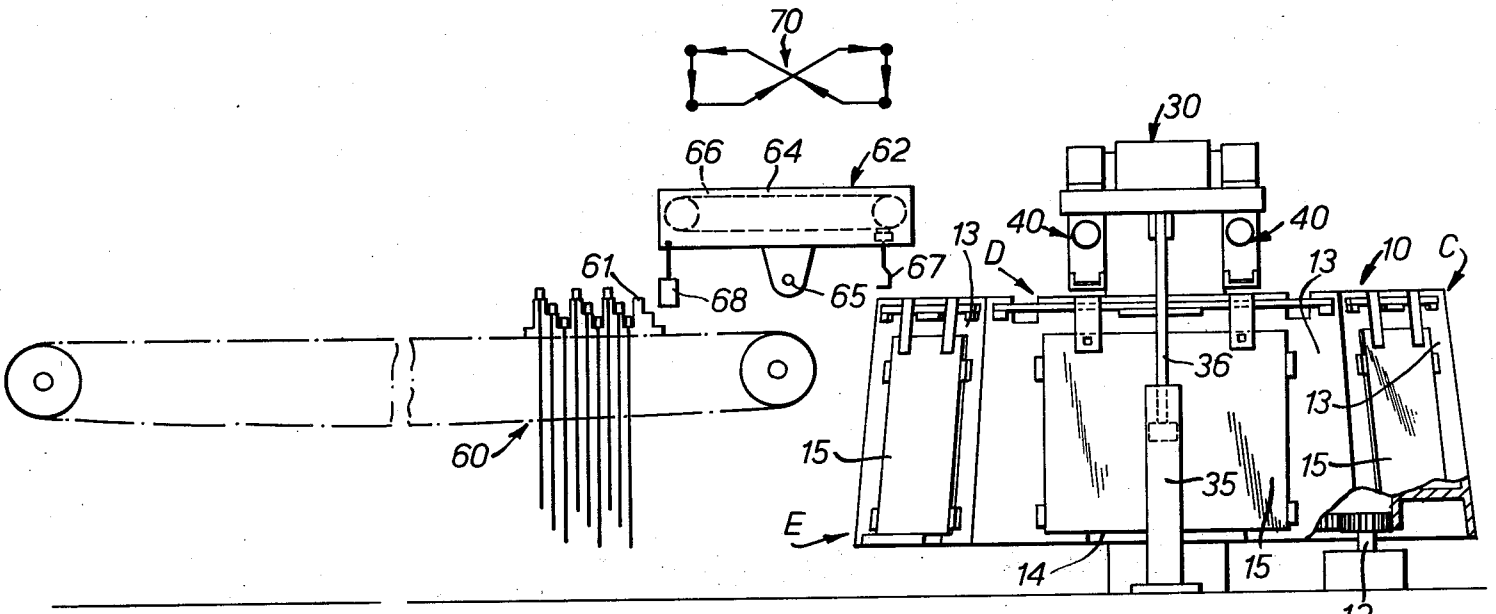
FIG. 3 is a side elevation of the machine of FIG. 2.
Figure 4:
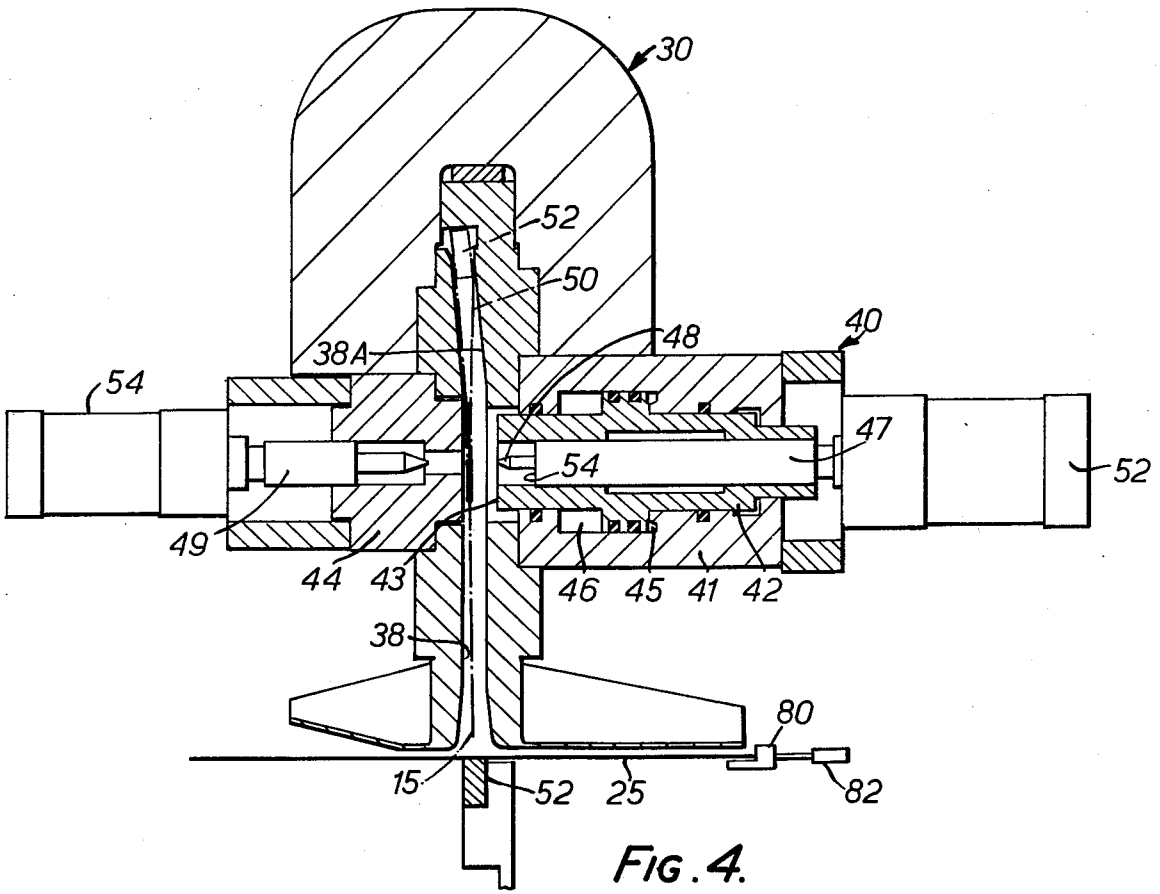
FIG. 4 is a sectional side elevation of part of the rivetting head of the machine of FIGS. 2 and 3.

FIGS. 2, 3 and 4 illustrate apparatus for carrying out this rivetting operation and constructed in accordance with the present invention. Thus FIGS. 2 and 3 illustrate a rotary turntable or turret 10 having a vertical axis, the turret being arranged to be driven about the axis by a turret drive 12 which is preferably an indexer and drive unit of a type supplied by Manifold Indexing Limited of Leyton, London, England. The turret comprises a framework of generally pentagonal form as viewed in plan and providing five substantially vertical table faces 13 each having a horizontal ledge 14 adjacent its lower edge for supporting a rectangular starting sheet 15. Manual or automatic means are provided for easily adjusting the position of the ledge 14 so that variations in sheet lengths can be accommodated. By means of the turret drive 12 the turret can be rotated in stepwise fashion through five stations A, B, C, D and E. At station B starting sheets are transferred to the turret by means of automatic transfer device 17 arranged to swing around a vertical axis 18 through 90° from the full line position shown, to the chain dotted line position shown, in order to transfer sheets from a sheet store 20 to the table face 13 positioned at station B at that time. The device 17 utilises pairs of rectractable arms 22 having suction pads 23.

At the next station C strips of material 25 to form loops, and also bars 52, are manually or automatically transferred from storage containers (not shown) to the turntable 10. FIG. 4 shows the manner in which the strip 25 is temporarily supported by a retractable support 80 connected to a piston and cylinder 82 which is actuated to rectract the support 80 just as rivetting head 30 is lowered. A bar 52 is shown in FIG. 2 in its horizontal position ready to have the loops 25 wrapped therearound and thereafter connected to the sheet 15 at station D. For this purpose the rivetting head 30 is provided at station D which is at one end of an arm 32 pivoted at the opposite side of the machine for movement up and down about a horizontal axis 33. The rivetting head is raised and lowered by means of a cylinder 35 and a piston 36 shown in FIG. 3. Instead of fixing the rivetting heads to the pivoted arm 32, they may alternatively be mounted on a carriage which can be moved by means such as the cylinder 35 in a sliding manner on a fixed framework adjacent and parallel to the face of the turret on which the sheet and loops are rivetted together. In the embodiment shown however the rivetting head, which is shown in detail in FIG. 4, includes a pair of guide channels 38 which are arranged to bend the loops unto U-form around the bar 52 and the upper edge of the sheet 15 when the rivetting head 30 is lowered. It will be observed in FIG. 4 that the quite channel 38 shown therein includes a vertical lower section and an inclined upper section 38A, which displaces the bar 26 laterally and positions it accurately so that the sheet 15 hangs properly in a cell when suspended by the bar 52.

Whilst the head 30 is in its lowered position the loops 50 are rivetted to the sheet 15 by means of a pair of horizontal rivet devices 40 which are shown only diagramatically in FIGS. 2 and 3 but which are shown in detail in sectional elevation in FIG. 4. Thus referring to FIG. 4 each rivetting device 40 comprises on the right hand side a main cylinder 41 in which is mounted a clamping piston 42 the left hand end 43 of which forces the two limbs of the loop 50 and the interleaved sheet 15 into close engagement with one another and with an anvil 44 on the further side of the rivet device 40. The piston 42 is powered to the left in FIG. 4 by introduction of hydraulic pressure into a chamber 45. Reverse operation is obtained by introduction of hydraulic pressure into a chamber 46. It is to be noted that a rivetting piston 47 which extends centrally through the clamping piston 42 remains stationary during the clamping operation so that a rivetting tool 48 on the left hand end of the rivetting piston 47 remains withdrawn.

As soon as clamping has been obtained by leftward movement of the clamping piston 42, a piercing piston 49 mounted for sliding movement within the anvil 44 is actuated by a further hydraulic cylinder 54 to cause the two limbs of the loop and the sheet to be pierced to form the triangular tongues of material 56 shown in FIG. 1, these tongues at this time extending axially of the piercing piston 49 i.e. at right angles to the sheet 15 and the limbs of the loop 50. After the piercing operation is completed the cylinder 54 causes the piercing piston 49 to be withdrawn, whereafter the cylinder 52 of the rivetting piston 47 is actuated to cause leftward movement of the rivetting tool 48. The tool is so shaped that it turns the axially lying triangular tongues 56 outwards and these are forced flush against the face of the adjacent side of the loop 50 by means of the end face 54 of the rivetting piston 47. Thereafter the rivetting piston 47 and the clamping piston 42 are withdrawn to the position shown in FIG. 4 and the rivetting head 30 is raised about the axis 33 so that the guide channels 38 are withdrawn from the assembled loops and sheet. In withdrawing the rivetting head the two limbs of the loop and the bar 26 are twisted slightly in order correctly to align them with respect to the hanging sheet 15.

Although not shown in FIGS. 2 and 3 it will be appreciated that the upper edge of the turret face 23 at each station has a pair of open topped cut-outs in line with the positions of the loops in order to enable the rivetting device to be positioned on each side of the table face.

After completing the assembly of the loops on the sheet the turntable in indexed to position the assembled sheets at station E from which the completed starting sheets are moved to a storage conveyor 60 which may have, as in conventional, a triple stacking tier 62 so that the uppermost row of sheets at any time can be removed enbloc by a tank-house crane for insertion into a refining cell. In other words, the storage conveyor 60 is large enough to accommodate three cell loads (as a minimum) of the assembled sheet. The sheets are carried from station E to the conveyor 60 by means of a transfer mechanism 62 which comprises a carriage support 64 mounted to rock about a pivot 65 together with a chain drive 66 carrying a pair of hooks 67. The support 64 is arranged to be rocked about the pivot 65 by a piston and cylinder 68. As shown in FIG. 2 the conveyor 60 has a drive unit 71 and the chain 66 has a drive unit 72. These units, together with the piston and cylinder 68 are linked to a control unit 74 so that by suitable phasing of the operation of the chain drive 66 and the piston and cylinder 68 the motion of the transfer hooks indicated at 70 can be obtained in order to lift the assembled starting sheets from station E, carry them leftwards to above the conveyor 60 and drop them onto the tier 61. The conveyor 60 is moved by its drive unit 71 one step forward each time a starting sheet is placed on it by the hooks 67.

The sheets 15 are brought in bulk to the store position 20 at station B from a flattening device, typically of the press or roller leveller type. In some instances the transfer mechanism 17 may be dispensed with and unflattened sheets placed on the turntable at station A rather than station B. In this case manual flapping of the sheets could take place at both stations A and B. The machine described is adaptable to automatic operation at various stages, for example, the bringing of the loops and bars into position at station C. Alternatively these operations can be carried out manually, depending on the circumstances.

If desired the drive mechanism for the turret could also symchronously drive the conveyor 60.

The horizontal disposition of the rivetting heads is advantageous because any debris including particles of copper created during the piercing or rivetting operation is swept out by the tools and falls clear to the ground or into a collecting receptacle. When the heads are vertical debris tends to remain in the rivetting dies etc., and has to be periodically cleaned out manually or by compressed air jets.

As is described in the early part of this specification, the machine described has the great advantage that the rivetting takes place with the sheets substantially vertical so that in transferring the sheets to the conveyor 60 very little tilting of the sheets is involved so that there is little or no danger of the sheets becoming distorted during this transfer process. This contrasts strongly with the known arrangements in which the rivetting takes place with the sheets lying horizontally whereafter the sheets have to be turned through 90° in order to hang them on the conveyors.

I claim:

1. A cathode starting sheet assembly machine comprising a flat support table arranged to support a starting sheet substantially vertically, and means for shifting the support table successively through a sheet loading station, a loop-securing station and an assembled-sheet-removal station.

2. A cathode starting sheet assembly machine comprising a vertical axis turntable having at least three circumferentially spaced, flat, tables the surface of each of which is substantially vertical, and indexing means for indexing the turntable about the vertical axis successively through a sheet loading station, a loop-securing station and an assembled-sheet-removal station.

3. An assembly machine as claimed in claim 2 including a pair of reciprocating rivetting heads at the securing station which are arranged to be lowered into alignment with the sheet for loop rivetting, and raised after loop rivetting.

4. An assembly machine as claimed in claim 3 in which the rivetting heads include substantially vertical guides which are adapted to bend flat loop strips into inverted U-shaped loops.

5. An assembly machine as claimed in claim 2 including, at the assembled-sheet-removal station, a storage conveyor for the finished starting sheets, on which conveyor the starting sheets are arranged to be hung vertically, and transfer mechanism for lifting the sheets from the removal station, shifting them laterally and depositing them on the storage conveyor.

6. A cathode starting sheet assembly machine comprising a vertical axis turntable affording a plurality of circumferentially spaced flat tables the surface of each of which is substantially vertical, indexing means for indexing the turntable about the vertical axis through a sheet loading station, a loop-strip loading station, a loop-rivetting station and an assembled-sheet-removal station, a sheet loading mechanism at the loading station, a loop-strip loading mechanism, at the loop-strip loading station, a loop strip bending mechanism and a loop-rivetting mechanism at the loop-rivetting station, and a finished-sheet-removal mechanism at the assembled-sheet-removal station.

7. A machine as claimed in claim 6 in which the loop rivetting mechanism includes at least one rivetting head mounted for movement upwards and downwards between a rivetting position and an inoperative position, the rivetting head including a guide mounted for movement over an upper edge of a sheet the guide being arranged to bend a loop strip into inverted U shape with parts of the limbs of the U positioned one on each side of the strip, a clamping piston on one side of the guide, an anvil on the opposite side of the guide and aligned with the clamping piston, a piercing piston mounted in one of the anvil and the clamping piston, and a rivetting piston mounted in the other of the anvil and the clamping piston.

8. A machine as claimed in claim 7 in which the guide has an upper end lying at a shallow angle to a lower part of the guide.

9. A machine as claimed in claim 7 in which the rivetting head is mounted on an arm which extends across the turntable and which is pivoted to part of the turntable for movement about a horizontal axis, and means for lifting and lowering the arm.

10. A machine as claimed in claim 6 in which the finished sheet-removal-mechanism includes a conveyor, at least one hook, first displacing means for shifting the hook substantially horizontally between the removal station and the vicinity of the conveyor, and second displacing means for shifting the hook upwards and downwards respectively, thereby lifting the sheet off the turntable and lowering the sheet onto the conveyor.

11. A machine as claimed in claim 6 in which the sheet loading mechanism comprises a sheet carrier mounted to rotate about a vertical axis.

12. A machine as claimed in claim 11 in which the sheet loading mechanism includes at least one plunger mounted to reciprocate horizontally and carrying a suction device.

13. A machine as claimed in claim 6 including support means at the rivetting station for supporting a loop-strip adjacent the bending mechanism, the support means being arranged to be shifted just prior to the operation of the bending mechanism.

14. A method of securing a loop to a cathode starting sheet comprising placing a starting sheet on a support while the support is at a loading station, the support supporting the sheet substantially vertically, shifting the sheet support to a loop securing station, securing a loop to the sheet while it is at the loop securing station, shifting the sheet support to a sheet removal station and removing the sheet and secured loop from the support.

15. A method of securing a loop to a cathode starting sheet comprising placing a starting sheet substantially vertically on one of at least three circumferentially spaced flat tables of a vertical axis turntable, the surfaces of each table being substantially vertical, said placing taking place while the turntable is at a sheet loading station, and indexing the turntable about the vertical axis through a loop securing station at which the loop is secured to the sheet and an assembled-sheet-removal station.

16. A method of securing a loop to a cathode starting sheet comprising placing the sheet on one of a plurality of circumferentially spaced flat tables the surface of each of which is substantially vertical, said placing taking place while the said one table is at a sheet loading station, indexing the turntable about the vertical axis to a loop strip and loop-support bar loading station, loading at least one loop strip and loop-support bar onto the turntable indexing the turntable to a loop rivetting station at which the loop is rivetted to the sheet, and indexing the turntable to an assembled-sheet-removal station and removing the sheet and secured loop from the said one table.

* * * * *